US005401130A

United States Patent [19]

Chiu et al.

[11] Patent Number: 5,401,130

[45] Date of Patent: Mar. 28, 1995

[54] INTERNAL CIRCULATION FLUIDIZED BED (ICFB) COMBUSTION SYSTEM AND METHOD OF OPERATION THEREOF

[75] Inventors: John H. Chiu, West Hartford; Michael J. Hargrove, Windsor Locks; Glen D. Jukkola, Glastonbury, all of Conn.; Mark A. Douglas, Navan, Canada; Stuart A. Morrison, Orleans, Canada; Steve Y. Wong, Kanata, Canada

[73] Assignee: Combustion Engineering, Inc., Windsor, Conn.

[21] Appl. No.: 173,539

[22] Filed: Dec. 23, 1993

[51] Int. Cl.[6] ..... F23G 5/00

[52] U.S. Cl. ..... 410/245; 122/4 D; 110/259

[58] Field of Search ..... 110/245; 122/4 D

[56] References Cited

U.S. PATENT DOCUMENTS

| | | | |
|---|---|---|---|
| 4,419,330 | 12/1983 | Ishihara et al. | 110/245 |
| 4,646,661 | 2/1987 | Roos et al. | 110/245 |
| 4,686,939 | 8/1987 | Stromberg | 122/4 D |
| 4,823,740 | 4/1989 | Ohshita et al. | 110/245 |
| 4,879,958 | 11/1989 | Allen et al. | 110/245 |
| 4,940,006 | 7/1990 | Temelli | 110/243 |
| 5,078,065 | 1/1992 | Tsuenemi et al. | 110/245 |

*Primary Examiner*—Henry C. Yuen

*Attorney, Agent, or Firm*—Arthur E. Fournier, Jr.

[57] ABSTRACT

A fluidized bed combustion system (10) particularly suited for use to effect the incineration, i.e., combustion, therewith of wood waste/sludge mixtures that have high moisture and ash content which makes them difficult to burn. The fluidized bed combustion system (10) includes a fluidized bed combustor (12) embodying a fluidized bed (24) composed of bed solids. Air is injected into the fluidized bed (24) through an air distributor (28) to establish a first controlled fluidizing velocity zone and a second controlled fluidizing velocity zone therewithin. Material (42b) is introduced into the fluidized bed combustor (12) above the second controlled fluidizing velocity zone. Bed solids are projected from the first controlled fluidizing velocity zone to the second controlled fluidizing velocity zone whereupon the bed solids rain down upon the material (**42*b*) and effect a covering thereof. The material (42*b*) is then dried and thereafter combusted. Inerts/tramp materials/clinkers as well as large diameter solids entrained with the material (42*b*) are segregated therefrom and then are removed (14,200) from the fluidized bed combustor (12**).

16 Claims, 3 Drawing Sheets

INTERNAL CIRCULATION FLUIDIZED BED (ICFB) COMBUSTION SYSTEM AND METHOD OF OPERATION THEREOF

BACKGROUND OF THE INVENTION

This invention relates to combustion systems, and more specifically, to a fluidized bed combustion system that is particularly suited for use for the purpose of effecting the combustion therewithin of a wide range of fuels of varying quality and moisture, and especially fuels such as high moisture wood waste and paper de-inking solids.

In a number of countries, forests are more than a source of lumber, pulp and paper. They are also an important component of the landscape and ecology of these countries. In addition, they constitute a major source of comparative advantage and foreign exchange for these countries as well as comprising the economic backbone of many of these countries' communities.

It can be expected that the pulp and paper industry during the 1990's will continue to spend heavily on environmental programs, and in particular on those that are designed to reduce effluent emission. In this regard, secondary effluent treatment, it is being found, is causing an increase in the amount of sludge that is being generated by many paper mills. Generally speaking, such sludges presently must either be landfilled or incinerated.

Coupled with the foregoing is the fact a major market force today in the pulp and paper industry, as reflected in the rapid growth in this market segment, is the demand for recycled paper products. Such paper recycling as well as the de-inking operations associated therewith can be expected to add to the quantity and character of the sludges that are presently being generated on-site within many paper mills.

To this end the period of rapid growth that paper recycling presently enjoys will no doubt drive the development and application of a host of technologies. Moreover, installing recycling and de-inking facilities will enable paper mills to produce products that will have a growing appeal to consumers around the world. Thus, the challenge, which the pulp and paper industry faces, is one of viewing the by-products of the de-inking process as being more than just another disposal problem.

Currently, the de-inking process being most commonly employed is flotation in which waste paper is washed and treated with NaOH. This treatment causes a swelling of the fibers, which in turn tends to loosen the ink particles and coating materials that are contained in the waste paper. Peroxides ($H_2O_2$) and surfactants are then added to bleach or "whiten" the fibers and to disperse the ink particles. The ink particles become hydrophobic in the process and attach themselves to rising air bubbles thereby enabling them to be removed in the form of a foam. The ink particles so removed together with the coating material that is removed and along with the rejects and water collectively form a wet mass that is commonly referred to as "de-inking sludge." Present mechanical dewatering techniques can only reduce the moisture content of the de-inking sludge to between 40% and 60% due to the sponging effect of the waste fiber contained therewithin. A typical de-inking plant of 250 tons per day capacity will yield, as by-products of the paper recycling and de-inking operations, approximately 20 bone dry tons per day of paper de-inking solids from the de-inking sludge.

As attention is being focused on what to do with these paper de-inking solids, various options are being considered. For example, at least one paper mill has initiated a program to truck the paper de-watering solids to local farmers who use the paper de-inking solids as a solid conditioning additive. On the other hand, landfilling the dewatered paper de-inking solids is often found to be the least expensive method of disposal thereof. However, local regulations and economics may dictate developing other methods of disposal of the paper de-inking solids, particularly should the production of such paper de-inking solids surge over the next few years as is currently being anticipated.

One of these other methods of disposal of paper de-inking solids is considered to be incineration. In this regard, an advantage that incineration is perceived to possess is that it permits the inorganic component of the paper de-inking solids to be recovered for possible reuse.

It is long been known in the prior art to provide combustion systems that are suitable for employment for purposes of effecting the incineration of materials. More specifically, the prior art is replete with examples of various types of combustion systems that have been used heretofore to effect the incineration of a multiplicity of different kinds of materials. In this regard, in many instances discernible differences of a structural nature can be found to exist between individual ones of the aforesaid combustion systems. The existence of such differences is in turn attributable for the most part to the diverse functional requirements that are associated with the individual applications in which such combustion systems are designed to be employed. For instance, in the selection of the particular type of combustion system that is to be utilized for a specific application one of the principal factors to which consideration must be given is that of the nature of the material that is intended to be incinerated through the use of the combustion system.

Waste material is one such material wherein combustion systems have been utilized for purposes of effecting the incineration thereof. Furthermore, fluidized bed combustion systems represent one such form of combustion system that has been utilized in this regard. By way of exemplification and not limitation, one example of a prior art form of fluidized bed combustion system that has heretodate been utilized for purposes of effecting therewith the incineration of waste material is that which forms the subject matter of British Patent No. 1,299,125 entitled "Improvements in Fluidized Bed Incineration," which was published on Dec. 6, 1972. In accordance with the teachings of British Patent No. 1,299,125, a method and apparatus for effecting the incineration of combustible refuse is provided wherein a bed of hot particulate refractory material is provided in an incinerator vessel having a first opening above one region of the bed and a second opening adjacent the base of the bed at a second region spaced horizontally from the first region. The bed of hot particulate refractory material is fluidized in a non-uniform manner to cause a greater degree of agitation of the bed at the second region than at the first region thereby promoting circulation of the material of the bed in the incinerator vessel in the direction downwardly from the first region and towards the second region. Through the first opening and onto the surface of the bed of the hot particulate refractory material there is introduced a mixture of combustible and non-combustible refuse such that the combustible content of the refuse is burned in the bed and the non-combustible content of the refuse is withdrawn through the second opening.

Another example, by way of exemplification and not limitation, of a prior art form of fluidized bed combustion system that has heretodate been utilized for purposes of effecting therewith the incineration of waste material is that which forms the subject matter of U.S. Pat. No. 4,419,330 entitled "Thermal Reactor of Fluidizing Bed Type," which issued on Dec. 6, 1983. In accordance with the teachings of U.S. Pat. No. 4,419,330, there is provided an incinerator of the fluidized bed type for effecting therewith the incineration of municipal refuse. The subject fluidized bed type incinerator includes a blower that supplies fluidizing gas upwardly into the incinerator through a diffusion means disposed at the lower part of the incinerator so as to fluidize the fluidizing medium or sand above a plate means. The fluidized medium is forced to move upwardly adjacent the side walls of the incinerator by the upwardly injected gas whereby the flow of the medium is directed against inclined deflecting walls such that whirling fluidized flows are created there as well as a downwardly descending bed between the whirling flows. Due to the presence of the whirling fluidized flows and the downwardly descending bed, the municipal refuse is alleged to be satisfactorily incinerated without obstruction to fluidization even though preshredding of the municipal refuse is not performed before the municipal refuse is charged into the incinerator.

Still another example, by way of exemplification and not limitation, of a prior art form of fluidized bed combustion system that has heretodate been utilized for purposes of effecting therewith the incineration of waste material is that which forms the subject matter of U.S. Pat. No. 4,823,740 entitled "Thermal Reactor," which issued on Apr. 25, 1989. In accordance with the teachings of U.S. Pat. No. 4,823,740, there is provided a thermal reactor of the fluidized bed type for effecting the incineration therewith of municipal waste wherein the fluidizing medium is caused to produce substantially two circulating zones A and B between which there exists a descending bed. Moreover, the materials to be burnt in the descending bed are entrained therein due to the presence of the oppositely circulating zones A and B. The subject thermal reactor in addition is provided with chambers on the outermost sides of each of the circulating zones A and B whereby a part of the fluidized bed under fluidization is directed into each of these chambers such as to thereby enable thermal energy to be recovered from the heated fluidizing medium passing therethrough.

Yet another example, by way of exemplification and not limitation, of a prior art form of fluidized bed combustion system that has heretodate been utilized for purposes of effecting therewith the incineration of waste material is that which forms the subject matter of U.S. Pat. No. 4,879,958 entitled "Fluidized Bed Reactor with Two Zone Combustion," which issued on Nov. 14, 1989. In accordance with the teachings of U.S. Pat. No. 4,879,958, there is provided a fluidized bed thermal reactor wherein circulating refractory material and fuel form a pair of fluidized beds, each revolving side by side. The fluidized bed thermal reactor also includes a hollow body which serves to divide the thermal reactor into an upper combustion zone and a lower combustion zone, and wherein by selecting the gas flow through the base of the reactor and by selectively positioning the deflector surfaces of the aforementioned hollow body, the desired flow direction of refractory material and fuel can be achieved, i.e., upwardly at the center of the thermal reactor and outwardly and downwardly at the outer edges thereof.

Yet still another example, by way of exemplification and not limitation, of a prior art form of fluidized bed combustion system that has heretodate been utilized for purposes of effecting therewith the incineration of waste material is that which forms the subject matter of U.S. Pat. No. 5,138,982 entitled "Internal Circulating Fluidized Bed Type Boiler and Method of Controlling the Same," which issued on Aug. 18, 1992. In accordance with the teachings of U.S. Pat. No. 5,138,982, there is provided a circulating type fluidized bed incinerator wherein the fluidizing medium at the portion near the side wall thereof that is provided with a combustible feeding device does not move violently up-and-down and forms a moving bed which experiences weak fluidization. The width of the moving bed is narrow at the upper portion thereof and is spread at the lower portion due to the difference in the mass flow of the air injected from the respective air chambers. That is, the trailing end of the moving bed extends above selected air chambers and, thus, the fluidizing medium is blown upwardly by the large mass flow from these chambers so as to be displaced therefrom whereby a part of the moving bed above the remaining air chamber descends by gravity. With such downward movement of a part of the moving bed, the fluidizing medium is supplemented from the fluidized bed accompanying a circulating flow towards the upper portion of the moving bed and with the repetition of the above, as a whole, the circulating fluidized bed is moved.

Although fluidized bed combustion systems constructed in accordance with the teachings of the aforereferenced patents under actual operating conditions have, for their intended purpose, provided adequate performances to date, a need has nevertheless been evidenced for modifications to be made thereto. More specifically, a need is being evidenced in the prior art for a new and improved fluidized bed combustion system that would be applicable, in particular, for use to effect the incineration therewith of wood waste/sludge, i.e., wood waste/paper de-inking solids, mixtures that have high moisture, i.e., up to 60%, and ash contents which makes them difficult to burn utilizing prior art forms of combustion systems. Moreover, there has been evidenced in the prior art a need for such a new and improved fluidized bed combustion system that would be particularly characterized in a number of respects. To this end, one such characteristic which such a new and improved fluidized bed combustion system would desirably possess is that the high moisture content wood waste/sludge, i.e., biomass, mixtures, which commonly are non-homogenous, be capable of being metered and introduced with a high degree of reliability into such a new and improved fluidized bed combustion system. Another characteristic which such a new and improved fluidized bed combustion system would desirably possess is the capability of enabling the biomass mixtures to be dried with minimum solid particle carryover and with minimum power consumption. A third characteristic which such a new and improved fluidized bed combustion system would desirably possess is the capability to provide enhanced internal recirculation of solids resulting from the optimization of the fluid bed width/depth/height, of the arch geometry/position, of the floor slope, of the fluidizing air velocity ratio, of the fluidizing air nozzle spacing and of the bed particle size distribution. A fourth characteristic which such a new and improved fluidized bed combustion system would desirably possess is the capability to effect a covering with hot solids of the biomass mixtures upon the introduction thereof into such a new and improved fluidized bed combustion system as well as the capability to effect thereafter the lateral dispersal of the biomass mixtures through the internal recirculation of the bed solids. A fifth characteristic which such a new and improved fluidized bed combustion system would desirably possess is the capability therewith of enabling inert/tramp material to be segregated at the lowermost portion of the fluidized bed such as to permit the removal thereof by means of a non-mechanical bed cleaning system. A sixth characteristic which such a new and improved fluidized bed combustion system would desirably possess is the capability to permit heat removed from the inert/tramp material during the cooling thereof to be returned to such a new and improved fluidized bed combustion system. A seventh characteristic which such a new and improved fluidized bed combustion system would desirably possess is the capability therewith of enabling large diameter solids in addition to the inert/tramp material to be removed from such a new and improved fluidized bed combustion system by means of a non-mechanical bed cleaning system. An eighth characteristic which such a new and improved fluidized bed combustion system would desirably possess is the capability to provide therewith aggressive internal solids circulation such as to thereby reduce the chances of large agglomerations of biomass mixtures forming by virtue of agglomerations being removed from the walls in the bed/freeboard transition area, by virtue of agglomerations being broken up within the bed, and by virtue of minimizing the formation of local hot spots within the fluidized bed due to inadequate solids mixing. A ninth characteristic which such a new and improved fluidized bed combustion system would desirably possess is that the entire arrangement be compact and ideally suited to retrofitting to existing steam generators. A tenth characteristic which such a new and improved fluidized bed combustion system would desirably possess is the capability to permit therewith maintenance of bed temperature and overfire air control to be effected by means of a simple control system. An eleventh characteristic which such a new and improved fluidized bed combustion system would desirably possess is the capability to permit therewith relatively constant levels of excess air to be maintained as load is decreased by virtue of reducing the air flow to selected portions of the fluidized bed as contrasted to certain prior art forms of fluidized bed combustion systems wherein excess air must be increased and overfire air must be decreased as load is decreased in order to avoid slumping the fluidized bed. To thus summarize, a need has thus been evidenced in the prior art for such a new and improved fluidized bed combustion system that would be especially applicable for use to effect the incineration therewith of waste material, and in particular wood waste/sludge, i.e., the wood waste/paper de-inking solids generated as a by-product of the paper recycling and de-inking operations that are conducted principally in the paper and pulp industry.

It is, therefore, an object of the present invention to provide a new and improved combustion system suitable for use to effect therewith the incineration of waste materials in particular.

It is another object of the present invention to provide such a new and improved combustion system for incinerating waste materials which is characterized in that it is of the fluidized bed type.

It is a further object of the present invention to provide such a new and improved fluidized bed combustion system that is particularly suited for use to effect therewith the incineration of waste material when such waste material comprises biomass material.

Another object of the present invention is to provide such a new and improved fluidized bed combustion system that is particularly suited for use to effect therewith the incineration of biomass material when such biomass material comprises wood waste/paper de-inking solids that have been generated as a by-product of paper recycling and de-inking operations of the type that are conducted by the paper and pulp industry.

A still other object of the present invention is to provide such a new and improved fluidized bed combustion system for incinerating such wood waste/paper de-inking solids which is characterized in that the wood waste/paper de-inking solids are subjected to drying prior to being incinerated.

A further object of the present invention is to provide such a new and improved fluidized bed combustion system for incinerating wood waste/paper de-inking solids which is characterized in that the drying of the wood waste/paper de-inking solids is accomplished by effecting the covering thereof with hot solids as the wood waste/paper de-inking solids are being introduced into the fluidized bed combustion system.

A still further object of the present invention is to provide such a new and improved fluidized bed combustion system for incinerating wood waste/paper de-inking solids which is characterized in that any inert/-tramp materials as well as large diameter solids entrained with the wood waste/paper de-inking solids are capable of being segregated therefrom and thereafter removed from the fluidized bed combustion system.

Yet another object of the present invention is to provide such a new and improved fluidized bed combustion system for incinerating wood waste/paper de-inking solids which is characterized in that heat is capable of being both removed from such inert/tramp material as well as large diameter solids during the cooling thereof and of then being recycled to the fluidized bed combustion system.

Yet a further object of the present invention is to provide such a new and improved fluidized bed combustion system for incinerating wood waste/paper de-inking solids wherein such incineration thereof is accomplished in an environmentally effective and efficient manner.

Yet another object of the present invention is to provide such a new and improved fluidized bed combustion system for incinerating wood waste/paper de-inking solids which is characterized by being equally well suited for use in retrofit applications as well as new applications.

Yet still another object of the present invention is to provide such a new and improved fluidized bed combustion system for incinerating wood waste/paper de-inking solids which is characterized by being easy to employ, by being reliable in operation, but which yet is relatively inexpensive to provide.

SUMMARY OF THE PRESENT INVENTION

In accordance with one aspect of the present invention there is provided a fluidized bed combustion system which is designed for use to effect the incineration therewith particularly of biomass materials having a high moisture content. The subject fluidized bed combustion system includes a fluidized bed combustor wherein the incineration of the high moisture biomass materials takes place. The fluidized bed combustor embodies a fluidized bed which is composed of bed solids and which is provided with several controlled fluidizing velocity zones. One of these controlled fluidizing velocity zones embodies a relatively high fluidizing velocity and a relatively low fluidized bed density, whereas another one of these controlled fluidizing velocity zones embodies a relatively low fluidizing velocity and a relatively high fluidized bed density. The controlled fluidizing velocity zone having the relatively high fluidizing velocity is bounded by a bed solids directionally guiding baffle. This bed solids directionally guiding baffle has a portion thereof submerged in the fluidized bed and the remainder thereof extending above the fluidized bed, and is designed to promote the growing in the bed solids/gas mixture of the fluidized bed of the gas bubbles, which are generated from the air that is introduced into the fluidized bed, in order to maximize the momentum within the fluidized bed of the bed solids/-gas mixture upward along the slope angle of the bed solids directionally guiding baffle until the end of the length of the bed solids directionally guiding baffle is reached, such that the momentum possessed by the bed solids/gas mixture coupled with the force created due to the bursting of the gas bubbles is operative to project the bed solids from the bed solids/gas mixture to the opposite side of the fluidized bed where the bed solids that have been so projected rain down over the fluidized bed. The upward movement of the bed solids in the relatively high fluidizing velocity zone that has a relatively low bed density is operative to cause bed solids to be drawn from the relatively low fluidized velocity zone of the fluidized bed that has a relatively high bed density to the relatively high fluidizing velocity zone of the fluidized bed as a consequence of the void created therein by virtue of the upward movement therewithin of the bed solids. There is, thus, created a circulation of the bed solids within the fluidized bed. Namely, there occurs movement of the bed solids/gas mixture along the bed solids directionally guiding baffle followed by the projection of the bed solids thereof to the other side, i.e., to the relatively low velocity zone, of the fluidized bed, and the eventual return of these bed solids from the relatively low fluidizing velocity zone to the relatively high fluidizing velocity zone, i.e., from the relatively high density portion to the relatively low density portion, of the fluidized bed through the operation of natural fluidization phenomena. Continuing, the subject fluidized bed combustion system further includes segregation and removal means operable to effect the segregation and thereafter removal from the fluidized bed combustor of the inert/tramp material as well as any large diameter solids that may be entrained in the biomass material that is to be incinerated through the use of the subject fluidized bed combustion system. In addition, the subject fluidized bed combustion system includes material feed means operable for effecting the introduction into the fluidized bed combustor of the biomass material that is intended to be incinerated therewithin. To this end, this material feed means is operative to cause the biomass material, which is to be incinerated, to be introduced into the fluidized bed combustor above the relatively low fluidizing velocity zone of the fluidized bed thereof. The biomass material so introduced by means of the material feed means either initially floats on top of the fluidized bed within the relatively low fluidizing velocity zone thereof or is immediately drawn into the fluidized bed such as by the influence thereupon of gravitational forces. In any event, to the extent the biomass material may initially float on top of the fluidized bed, the biomass material soon becomes covered by hot bed solids that rain down thereupon after being projected from the other side, i.e., from the relatively high fluidizing velocity zone, of the fluidized bed. As a consequence of being so covered by these hot bed solids the biomass material not only becomes mixed therewith, but also rapidly undergoes drying followed by the combustion thereof during which water vapor and volatile matter are concomitantly released from the biomass material. Such drying and combustion of the biomass material occurs by virtue of the biomass material being subjected to radiant heat from the hot bed solids and from the fluidized bed combustor, to convection heat from the gases of combustion and the hot bed solids, and to direct contact with the hot bed solids that are rained down thereupon and/or with which the biomass material becomes mixed within the fluidized bed.

In accordance with another aspect of the present invention there is provided a method of operating a fluidized bed combustion system that is designed for use to effect the incineration therewith particularly of biomass materials having a high moisture content. The subject method of operation of the fluidized bed combustion system includes the steps of providing a fluidized bed combustor embodying a fluidized bed composed of bed solids, establishing within the fluidized bed on one side thereof a first controlled fluidizing velocity zone wherein there exists a relatively high fluidizing velocity and a relatively low fluidized bed density, establishing within the fluidized bed on the other side thereof a second controlled fluidizing velocity zone wherein there exists a relatively low fluidizing velocity zone and a relatively high fluidized bed density, promoting the growing of the gas bubbles in the bed solids/gas mixture within the first controlled fluidizing velocity zone of the fluidized bed, projecting bed solids from the first controlled fluidizing velocity zone of the fluidized bed to the other side of the fluidized bed as a consequence of the momentum possessed by the bed solids/gas mixture coupled with the forces created due to the bursting of the gas bubbles, introducing into the fluidized bed combustor the material to be incinerated therewithin such that the material is so introduced above the second controlled fluidizing velocity zone of the fluidized bed, covering the material so introduced which is to be incinerated with hot bed solids that rain down thereupon after being projected from the first controlled fluidizing velocity zone to the second controlled fluidizing velocity zone, effecting the drying of the material so introduced followed by the combustion thereof by virtue of such material being subjected to radiant heat from the hot bed solids and the fluidized bed combustor and convection heat from the hot bed solids and from the gases of combustion that are generated from the combustion of material and from direct contact between the material and the hot bed solids that are rained down thereupon and/or with which the material becomes mixed within the fluidized bed, creating a circulation of the bed solids within the fluidized bed wherein hot bed solids are projected from the first controlled fluidizing velocity zone of the fluidized bed to the second controlled fluidizing velocity zone of the fluidized bed and through operation of natural fluidization phenomena are returned to the first controlled fluidizing velocity zone of the fluidized bed from the second controlled fluidizing velocity zone of the fluidized bed, and effecting the segregation and thereafter removal from the fluidized bed combustor of inert/-tramp material as well as large diameter solids that may be entrained in the material that is introduced into the fluidized bed combustor for incineration therewithin.

DESCRIPTION OF THE PREFERRED EMBODIMENT

Figure 1:
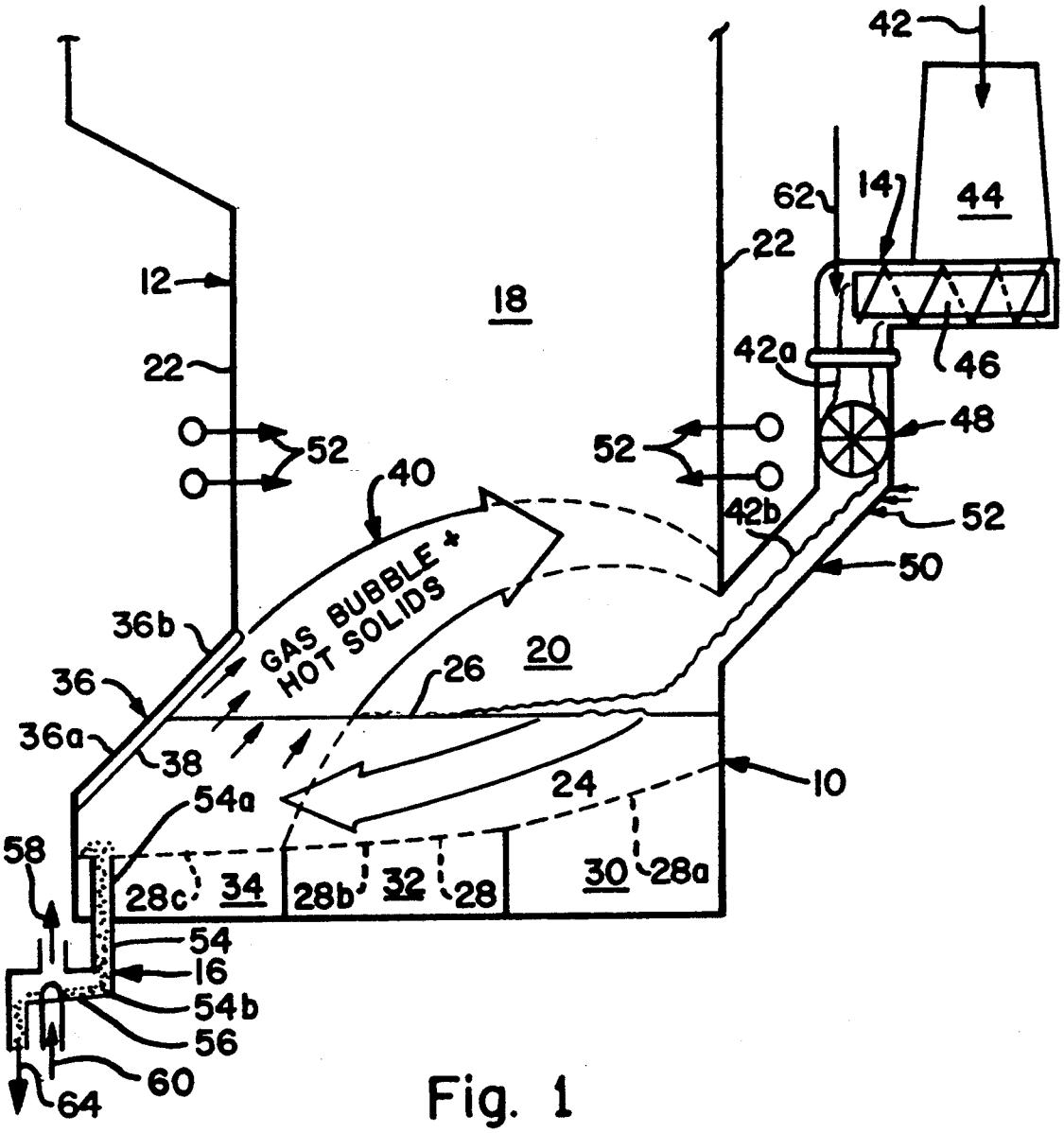
FIG. 1 is a diagrammatic representation in the nature of a vertical sectional view of an embodiment of a fluidized bed combustion system constructed in accordance with the present invention.

Referring now to the drawing, and more particularly to FIG. 1 thereof, there is depicted therein a fluidized bed combustion system, generally designated by the reference numeral 10, constructed in accordance with the present invention. As depicted in FIG. 1, the major components of the fluidized bed combustion system 10 are the fluid bed combustor, generally designated by the reference numeral 12, the material feed means, generally designated by the reference numeral 14, and the removal means, generally designated by the reference numeral 16.

Each of the above-enumerated components of the fluidized bed combustion system 10 will now be discussed in detail commencing with a description of the fluidized bed combustor 12. To this end, the fluidized bed combustor 12, as depicted in FIG. 1 of the drawing, includes an upper portion, denoted therein by the reference number 18, and a lower portion, denoted therein by the reference numeral 20. As will be described more fully hereinafter, it is within the lower portion 20 of the fluidized bed combustor 12 that some of the combustion, i.e., incineration, of the material, which is introduced into the fluidized bed combustor 12 for the purpose of undergoing such combustion, is accomplished. The hot gases that are generated from the combustion of material within the lower portion 20 of the fluidized bed combustor 12 rise upwardly in the fluidized bed combustor 12. During the upwardly movement thereof in the fluidized bed combustor 12, the hot combustion gases may be made to give up heat to fluid passing through tubes (not shown in the interest of maintaining clarity of illustration in the drawing) from which the walls, denoted by the reference numeral 22 in FIG. 1, of the fluidized bed combustor 12 may be formed. Thereafter, the hot combustion gases exit (not shown) from the upper portion 18 of the fluidized bed combustor 12. In those instances wherein the hot combustion gases are made to give up heat to fluid passing through the tubes from which the walls 22 of the fluidized bed combustor 12 are formed, such heat is operative to cause the fluid, i.e., water, passing through the tubes to be transformed to steam. This steam may then in turn be utilized for various purposes including but not limited to power generation, district heating, in industrial processes, etc.

Continuing with the description of the fluidized bed combustor 12, as best understood with reference to FIG. 1 of the drawing the fluidized bed combustor 12 is provided in the lower portion 20 thereof with a fluidized bed, denoted generally therein by the reference numeral 24. The fluidized bed 24 is composed of bed solids, which in accord with the best mode embodiment of the invention preferably consists of sand. For ease of reference, the upper level of the fluidized bed 24 is denoted in FIG. 1 by the reference numeral 26. The fluidized bed 24 rests upon an air distributor denoted by the dotted line, which is identified generally in FIG. 1 of the drawing by the reference numeral 28. The air distributor 28 may take many forms. Namely, the air distributor 28 may consist of a grate, a distributor plate, etc., without departing from the essence of the present invention. For a purpose to which further reference will be made hereinafter, the air distributor 28, as will be best understood with reference to FIG. 1 of the drawing, includes a first portion, seen at **28*a* in FIG. 1, that embodies a relatively high degree of slope, a second portion, seen at 28*b* in FIG. 1, that embodies a lesser degree of slope, and a third portion, seen at 28*c* in FIG. 1**, that embodies an even lesser degree of slope.

In accord with the illustrated embodiment of the invention as depicted in FIG. 1 of the drawing, there are provided below the air distributor 28 three under bed air plenums, denoted by the reference numerals 30, 32 and 34, respectively, in FIG. 1. Although three under bed air plenums 30, 32 and 34 have been depicted in FIG. 1 of the drawing, it is to be understood that a greater or a lesser number thereof might equally well be provided without departing from the essence of the present invention. The under bed air plenums 30, 32 and 34 are designed to be operative to divide the fluidized bed 24 into several controlled fluidizing velocity zones. To this end, air is injected from the under bed air plenums 30, 32 and 34 at preselected velocities into the fluidized bed 24. Although not illustrated in the drawing, it is to be understood that each of the under bed air plenums, 30, 32 and 34 is connected in fluid flow relation with an externally located source of fluidizing air from which the under bed air plenums 30, 32 and 34 are suitably provided with such fluidizing air so as to thereby be operative to effect the injection therefrom into the fluidized bed 24 of fluidizing air at the desired preselected velocities. More specifically, the air is injected into the fluidized bed 24 at a relatively low fluidizing velocity of for example two to three feet per second from the under bed air plenum 30, while on the other hand the air is injected into the fluidized bed 24 at a relatively high fluidizing velocity of for example five to twelve feet per second from the under bed air plenum 34. The effect thereof thus is to establish a relatively low fluidizing velocity within the fluidized bed 24 above the under bed air plenum 30, and a relatively high fluidizing velocity zone within the fluidized bed 24 above the under bed air plenum 34. Concomitant with the establishment of such relatively low and relatively high fluidizing velocity zones within the fluidized bed 24 is the establishment also in the fluidized bed 24 of a zone of relatively high bed density and a zone of relatively low bed density. Namely, the bed density within the fluidized bed 24 above the under bed air plenum 30 wherein the relative low fluidizing velocity zone exists is relatively high, whereas the bed density within the fluidized bed 24 above the under bed air plenum 34 wherein the relatively high fluidizing velocity zone exists is relatively low.

As best understood with reference to FIG. 1 of the drawing, a portion of the relatively high fluidizing velocity zone of the fluidized bed 24 is bounded by a baffle, generally designated therein by the reference numeral 36. To this end, the baffle 36 comprises the sloping portion of one of the exterior walls 22 of the fluidized bed combustor 12. As such, the baffle 36 is designed so as to have one portion thereof, denoted in FIG. 1 by the reference numeral 36*a*, that extends below the level 26 of the fluidized bed 24, and another portion thereof, denoted in FIG. 1 by the reference numeral 36*b*, that extends above the level 26 of the fluidized bed 24. In accord with the best mode embodiment of the invention, the angle of slope of the baffle 36 is preferably made to be between 30° and 45° from the horizontal. The baffle 36 as depicted in FIG. 1 of the drawing in addition is preferably provided with a liner, denoted therein by the reference numeral 38, comprised of a conventional refractory-type material that is suitable for use for such a purpose.

Continuing with the description thereof, the baffle 36 is intended to be operative to effect the directional guiding of the bed solids within the relatively high fluidizing velocity zone of the fluidized bed 24. More specifically, the baffle 36 is designed to promote the growth of the gas bubbles associated with the bed solids/gas mixture, which mixture is created in the relatively high fluidizing velocity zone of the fluidized bed 24 by virtue of the injection thereinto through the air distributor 28 of fluidizing air from the under bed air plenum 34. Such growth of the gas bubbles associated with the bed solids/gas mixture within the relatively high fluidizing velocity zone of the fluidized bed 24 is promoted in order to maximize the momentum of the bed solids/gas mixture along the angle of slope of the baffle 36 until the end of the length of the baffle 36 is reached thereby. The momentum of the bed solids/gas mixture in turn is sought to be maximized in order that the momentum of the bed solids/gas mixture as the bed solids/gas mixture reaches the end of the length of the baffle 36, which extends above the level 26 of the fluidized bed 24, when coupled with the force created by the gas bubbles bursting will be sufficient to effect the projection of the bed solids of the bed solids/gas mixture to the other side of the fluidized bed combustor 12 whereupon these bed solids under the influence of gravity rain down upon the relatively low fluidizing velocity zone of the fluidized bed 24, which is located above the under bed air plenum 30. Such projection of the bed solids is schematically depicted in FIG. 1 of the drawing by means of the arrow that is denoted therein generally by the reference numeral 40. The upward movement of the bed solids/gas mixture within the relatively high fluidized velocity zone of the fluidized bed 24 wherein a relatively low bed density exists is operative to cause there to be drawn into the void created by such upward movement fluidized bed solids from the relatively low fluidizing velocity zone of the fluidized bed 24 wherein a relatively high bed density exists. Consequently, a circulation of fluidized bed solids within the fluidized bed 24 is created. Namely, the bed solids/gas mixture moves upwardly within the relatively high fluidizing velocity zone of the fluidized bed 24 and then along the length of the baffle 36 until the bed solids thereof are projected across the width of the fluidized bed combustor 12 and rain down upon the relatively low fluidizing velocity zone of the fluidized bed 24, and eventually through the operation of natural fluidization phenomena return to the relatively high fluidizing velocity zone of the fluidized bed 24 from the relatively low fluidizing velocity zone thereof whereupon the process once again repeats itself.

A description will next be had herein of the material feed means 14 of the fluidized bed combustion system 10 of the present invention. For this purpose, reference will once again be had to FIG. 1 of the drawing. With reference, therefore, to FIG. 1 of the drawing the material, depicted therein schematically by the arrow denoted by the reference numeral 42, such as biomass material in the form of wood waste/sludge, wood waste/paper de-inking solids, etc., that is to be subjected to incineration, i.e., combustion, within the fluidized bed combustor 12 is preferably supplied thereto from a bin, denoted in FIG. 1 by the reference numeral 44. The bin 44, as shown in FIG. 1, has cooperatively associated therewith screw means, denoted therein by the reference numeral 46. It is through operation of the large shank diameter screw feeders of the screw means 46 that the material 42 is fed from the bin 44 and upon reaching the screw tip of the screw means 46 is discharged therefrom, as schematically depicted in FIG. 1 of the drawing by the reference numeral 42*a*, to a rotary air lock means, denoted generally in FIG. 1 by the reference numeral 48. The rotary air lock means 48, as illustrated in FIG. 1 of the drawing, is interposed between the screw means 46 and the chute, denoted generally in FIG. 1 by the reference numeral 50. In known fashion, the rotary air lock means 48 embodies a plurality of rotary feeders that are designed to be operative to discharge material, as schematically depicted in FIG. 1 by the reference numeral 42*b*, from the rotary air lock means 48 to the chute 50. The chute 50, as seen with reference to FIG. 1 of the drawing, is relatively steeply sloped, and is preferably lined with refractory material (not shown in the interest of maintaining clarity of illustration in the drawing). In addition, the chute 50 is preferably provided at various locations thereof, as schematically depicted in FIG. 1 by the arrows denoted therein by the reference numeral 51, with fluidizing air and/or recirculating gas to assist the material 42*b* in its flow down the chute 50. As such, the material 42*b* is made to flow through the chute 50 due to the influence of gravity upon the material 42*b* occasioned by the relatively steep slope of the chute 50 and due to the assistance of the fluidizing air 51 that is injected into the chute 50.

Continuing with the description of the material feed means 14, the chute 50, as best understood with reference to FIG. 1 of the drawing, opens directly over the fluidized bed 24 and, more specifically, over the relatively low fluidizing velocity zone thereof. To this end, the material 42*b* is thus introduced, i.e., injected, over the relatively low fluidizing velocity zone of the fluidized bed 24 whereby the material 42*b* either initially floats on top of the fluidized bed 24 within the relatively low fluidizing velocity zone thereof or is immediately drawn into the fluidized bed 24 such as by the influence thereupon of gravitational forces. Further, to the extent the material 42*b* may initially float on top of the fluidized bed 24, the material 42*b* soon becomes covered by hot bed solids that rain down thereupon after being projected from the other side, i.e., from the relatively high fluidizing velocity zone, of the fluidized bed 24. As a consequence of being so covered by these hot bed solids, the material 42*b* not only becomes mixed therewith, but also rapidly undergoes drying followed by the combustion, i.e., incineration, thereof during which water vapor and volatile matter are concomitantly released from the material 42*b*. Such drying and combustion, i.e., incineration, of the material 42*b* occurs by virtue of the material 42*b* being subjected to radiant heat from the hot bed solids and/or the fluidized bed combustor 12, to convection heat from the interaction of the material 42*b* being fed and the gases of combustion generated from the combustion of the material 42*b*, and to direct contact with the hot bed solids that rain down thereupon and/or those that are present in the fluidized bed 24. As the material 42*b*, in accordance with natural fluidization phenomena, migrates within the fluidized bed 24 from the relatively low fluidizing velocity thereof to the relatively high fluidizing velocity zone thereof, the material 42*b* continues to dry, devolatilize and burn. Due to the higher oxygen ratio available within the relatively high fluidizing velocity zone of the fluidized bed 24 as a consequence of the amount of air that is injected thereinto at a relatively high velocity and by virtue of the fact that by the time the material 42*b* reaches the relatively high fluidizing velocity zone of the fluidized bed 24 the material 42*b* has been, substantially if not entirely, dried, the combustion of the material 42*b* proceeds at an enhanced rate within the relatively high fluidizing velocity zone of the fluidized bed 24. Any fines that result from the combustion of the material 42*b* within the fluidized bed 24 will continue to burn as they elutriate to the upper portion 18 of the fluidized bed combustor 12. In accordance with the illustrated embodiment of the fluidized bed combustion system 10, in the upper portion 18 of the fluidized bed combustor 12 secondary air, denoted by the reference numeral 52 in FIG. 1 of the drawing, is introduced, i.e., injected, thereinto from opposite walls 22 of the fluidized bed combustor 12 for utilization in effecting the completion of the combustion of any portion of the material 42*b* that may elutriate to the upper portion 18 of the fluidized bed combustor 12. The secondary air 52 also is designed to function in the manner of a curtain to prevent hot bed solids from elutriating to the upper portion 18 of the fluidized bed combustor 12.

A description will next be had herein of the removal 16 of the fluidized bed combustion system 10. For this purpose, reference will once again be had to FIG. 1 of the drawing. As best understood with reference to FIG. 1 of the drawing, the air distributor 28, in accordance with the best mode embodiment of the invention, is preferably inclined in a downwardly direction from the portion thereof, denoted by the reference numeral 28*a* in FIG. 1, that underlies the relatively low fluidizing velocity zone of the fluidized bed 24 to the portion thereof, denoted by the reference numeral 28*c* in FIG. 1, that underlies the relatively high fluidizing velocity zone of the fluidized bed 24. By virtue of this downward inclination of the air distributor 28 coupled with the fluidizing nozzles (not shown in the interest of maintaining clarity of illustration in the drawing), by which the fluidizing air is injected into the fluidized bed 24 through the air distributor 28, being arranged in the direction in which the air distributor 28 is inclined is operative to cause any inert/tramp material as well as large diameter solids, which are hard to fluidize and which may be entrained in the material 42*b*, to be channeled towards the removal means 16.

Continuing with the description thereof, the removal means 16 in accordance with the illustrated embodiment thereof takes the form of a seal loop, denoted in FIG. 1 by the reference numeral 54. The seal loop 54 includes a first leg, denoted by the reference numeral 54*a*, that has a drain opening formed at one end thereof such that this drain opening is located in juxtaposed relation to the air distributor 28 so as to be operative to receive therewithin inert/tramp material as well as large diameter solids from the air distributor 28. The first leg 54*a* of the seal loop 54 extends from the air distributor 28 through the air plenum 34 to the exterior of the fluidized bed combustor 12 whereat this first leg 54*a* is joined to a second leg 54*b* of the seal loop 54. Preferably, fluidizing/classifying air is introduced, i.e., injected, as denoted in FIG. 1 by the reference numeral 56, into the second leg 54*b* of the seal loop 54 for purposes of effecting the fluidizing/classifying of the fines that are associated with the inert/tramp material as well as large diameter solids, which drain into the first leg 54*a* of the seal loop, i.e., which flow thereinto through the drain opening provided at the end of the first leg 54*a* of the seal loop 54. The fines that are so classified by the fluidizing/classifying air 56 then are in turn recycled, as denoted by the reference numeral 58 in FIG. 1, by the air that is introduced, as shown by the reference numeral 60 in FIG. 1, into the second leg 54*b* of the seal loop 54, either (not shown) to the lower portion 20 of the fluidized bed combustor 12 for reinjection thereinto or as depicted by the arrow denoted by the reference numeral 62 in FIG. 1 to the material feed means 14 for reinjection thereto. On the other hand, the remaining portions of the inert/tramp material as well as large diameter solids, i.e., everything but the fines, are discharged, as depicted by the arrow denoted in FIG. 1 by the reference numeral 64, from the seal loop 54 such as to a cooling/heat recovery unit (not shown), which may take the form of a water submerged scraper conveyor, or a water cooled hollow flight screw conveyor, or a heat recovery fluidized bed, before the actual disposal thereof is effected.

Thus, by way of a summarization of some of the principal characteristics of the fluidized bed combustion system 10 constructed in accordance with the present invention, one such characteristic is deemed to reside in the fact that the baffle 36, which has the portion 36*a* thereof submerged in the fluidized bed 24 and the remaining portion 36*b* thereof extending above the fluidized bed 24, is designed to bound the relatively high fluidizing velocity zone of the fluidized bed 24 so as to thereby be operative to promote the growth therewithin of the gas bubbles in the bed solids/gas mixture in order to thereby maximize the momentum of the bed solids/gas mixture upward along the angle of slope of the baffle 36 until the upper end, as viewed with reference to FIG. 1, of the length of the baffle 36 is reached thereby, such that the momentum projected by the bed solids/gas mixture and the force created due to the bursting of the gas bubbles is effective to project the bed solids to the opposite side of the fluidized bed 24 whereupon they rain down on to the top of the relatively low fluidizing velocity zone of the fluidized bed 24. The variable bed density that exists between the relatively low fluidizing velocity zone of the fluidized bed 24 and the relatively high fluidizing velocity zone thereof created by the velocity differences that exist in the fluidized bed 24 promotes the circulation of the bed solids and the material 42*b* within the fluidized bed 24 from the relatively low fluidizing velocity zone thereof to the relatively high fluidizing velocity zone thereof.

A second such principal characteristic of the fluidized bed combustion system 10 constructed in accordance with the principal invention is that the material 42*b*, or portions thereof, either may be dropped on top of the relatively low fluidizing velocity zone of the fluidized bed 24 or may be conveyed therewithin. To this end, the downward movement of the bed solids drags some of the material 42*b* down into the relatively low fluidizing velocity zone of the fluidized bed 24 where it is dried, partially pyrolized, and dispersed toward the relatively high fluidizing velocity zone of the fluidized bed 24 for further combustion. The lighter portion of the material 42*b*, which floats on the top surface of the relatively low fluidizing velocity zone of the fluidized bed 24, becomes covered/mixed with the hot bed solids that rain down thereupon after being projected thereto from the baffle-bounded relatively high fluidizing velocity zone of the fluidized bed 24. The hot bed solids that rain down on the relatively low fluidizing velocity zone of the fluidized bed 24 also act in the manner of a curtain to reduce the extent to which fines escape from the fluidized bed 24 to the upper portion 18 of the fluidized bed combustor 12. Also, the low velocity that exists within the relatively low fluidizing velocity zone of the fluidized bed 24 minimizes the elutriation of fines and bed solids therefrom, thus reducing the heat release in the freeboard of the fluidized bed combustor 12 and enhancing the efficiency of combustion of the material 42*b*. As such, this approach promotes combustion of the material 42*b* in the fluidized bed 24 and confines freeboard combustion to within the bed solids that rain down on the fluidized bed 24 thereby providing the fluidized bed combustion system 10 with a longer bed solids residence time.

A third such principal characteristic of the fluidized bed combustion system 10 constructed in accordance with the present invention is deemed to reside in the fact that the use of the baffle-bounded relatively high fluidizing velocity zone combined with overfire air allows for the designing of a low stoichiometric air combustion in the fluidized bed 24 and hence a small fluidized bed plan area, a feature highly necessary for retrofitting existing steam generation units, which have limited available space, with the fluidized bed combustion system 10. Moreover, by virtue of the fact that the fluidized 5 bed combustion system 10 is characterized by relatively less solids carryover to the upper portion of the fluidized bed combustor 12 enables the existing upper portion of the steam generator unit as well as the downstream heat exchangers thereof to be retained to the maximum extent when such a steam generator unit is being retrofitted with the fluidized bed combustion system 10.

A fourth such principal characteristic of the fluidized bed combustion system 10 constructed in accordance with the present invention is deemed to reside in the fact that the use of air injected above the fluidized bed 24 allows excess air to be reduced in the fluidized bed 24 without sacrificing combustion efficiency, while yet enabling $NO_x$ emissions to be reduced. Optimized velocity and distribution of such air injected from the upper portion 18 of the fluidized bed combustor 12 also minimizes particle entrainment from the fluidized bed 24 into the upper portion 18 of the fluidized bed combustor 12 by deflecting such particles back towards the fluidized bed 24.

A fifth such principal characteristic of the fluidized bed combustion system 10 constructed in accordance with the present invention is deemed to reside in the fact that the fluidizing air nozzles associated with the air distributor 28 are directionally arranged so as to be operative to continuously channel the hard-to-fluidized heavy agglomerations of inert/tramp material or clinkers, which lie on the top of the air distributor 28 towards the drain opening with which the first leg 54*a* of the seal loop 54 is provided. High internal bed solids circulation rates also promote the movement of oversize material towards the drain opening with which the first leg 54*a* of the seal loop 54 is provided, thus minimizing the risk of clinkers accumulating and of the defluidizing of the fluidized bed 24.

A sixth such principal characteristic of the fluidized bed combustion system 10 constructed in accordance with the present invention is deemed to reside in the fact that the removal system 16 thereof enables the fine particles and sensible heat to be recovered from the inert/tramp material as well as large diameter solids that pass therethrough. As such, the removal system 16 has the potential of minimizing or even eliminating the need for any additional heat recovery equipment of the type commonly utilized for ash disposal purposes.

A seventh such principal characteristic of the fluidized bed combustion system 10 constructed in accordance with the present invention is deemed to reside in the fact that multi-zone start-up methods similar to those employed in bubbling bed units are capable of being utilized with the fluidized bed combustion system 10 thereby providing for a great deal of flexibility in starting up a unit that is equipped with the fluidized bed combustion system 10. In this regard, start-up rates may, however, be limited by the fact that the refractory insulation employed therein may need to be warmed up and/or by the steam side equipment associated therewith due to the heavy wall thickness thereof.

An eighth such principal characteristic of the fluidized bed combustion system 10 constructed in accordance with the present invention is deemed to reside in the fact that the use of variable velocity zones within the fluidized bed 24 has turndown advantages over conventional single velocity fluidized beds. This is because of the flexibility in distributing the air among the velocity zones within the fluidized bed 24 and/or the air that is injected above the fluidized bed 24 according to the load requirement, the characteristics of the material 42*b* and the size distribution of the bed solids.

A ninth such principal characteristic of the fluidized bed combustion system 10 constructed in accordance with the present invention is deemed to reside in the fact that the bed solids size distribution is chosen to ensure favorable fluidization in the relatively low fluidizing velocity zone of the fluidized bed 24 and to maximize the trajectory of the bed solids from baffle-bounded relatively high fluidizing velocity zone of the fluidized bed 24 to the relatively low fluidizing velocity zone thereof.

A tenth such principal characteristic of the fluidized bed combustion system 10 constructed in accordance with the present invention is deemed to reside in the fact that very high moisture materials can be accommodated therewith and that materials of varying characteristics can likewise be handled therewith.

Figure 2:
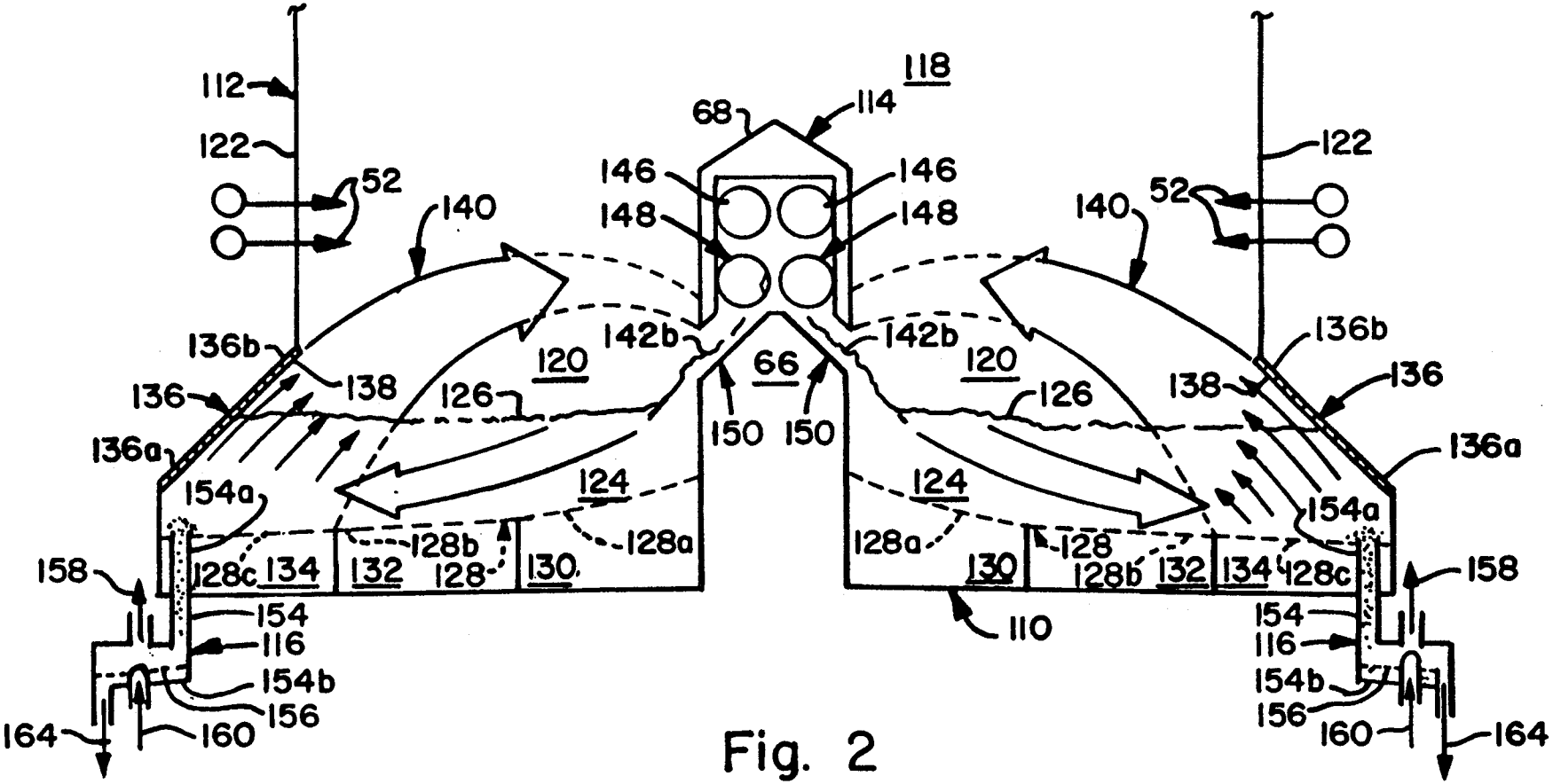
FIG. 2 is a diagrammatic representation in the nature of a vertical sectional view of another embodiment of a fluidized bed combustion system constructed in accordance with the present invention.

In the event that the fluidized bed combustion system 10 illustrated in FIG. 1 of the drawing needs to be scaled up in size, one way of accomplishing this is shown in FIG. 2 of the drawing. Namely, for this purpose the fluidized bed combustion system 10 may be provided with a mirror image of itself. For ease of reference the same reference numerals as those employed in FIG. 1 with the prefix 1 added thereto are used with respect to the elements of the embodiment of FIG. 2, and to this end the respective functions of these elements may be considered to be the same as the corresponding elements appearing in FIG. 1 without the prefix 1.

Thus, as best understood with reference to FIG. 2 of the drawing, in order to scale up for a large size unit the fluidized bed combustion system 10 constructed in accordance with the present invention is modified so as to embody a mirror image of itself whereby the result is the fluidized bed combustion system, which is illustrated in FIG. 2 and which is denoted generally therein by the reference numeral 110. To this end, the fluidized bed combustion system 110 of FIG. 2 embodies a mode of operation whereby there occurs therewithin baffle-bounded directional fluidized bed solids/gas movement towards the center of the fluidized bed combustor 112. For this purpose, the fluidized bed combustion system 112 as best understood with reference to FIG. 2 of the drawing preferably embodies a pant-leg type configuration, denoted generally by the reference numeral 66 in FIG. 2.

Continuing with the description of the fluidized bed combustion system 110 of FIG. 2, in accord with the mode of operation thereof material is fed into the fluidized bed combustor 112 by means of the material feed means 114, whereby as best understood with reference to FIG. 2 of the drawing such material is introduced uniformly from the center of the fluidized bed combustor 112 rather than from the side thereof as in the case of the fluidized bed combustor 12 of FIG. 1. Moreover, such uniform introduction of the material is effected by means of dual non-consolidating screws, each being denoted by the same reference numeral 146 in FIG. 2. The dual non-consolidating screws 146 in turn are designed to be fed from two live bottom bins (not shown) similar in construction and mode of operation to the bin 44 of FIG. 1, which are preferably located one at each side of the fluidized bed combustor 112. The dual non-consolidating screws 146 are operative to feed the material to the two rotary air locks, each denoted by the same reference numeral 148 in FIG. 2, whereupon the material as shown at **142*b* in FIG. 2 is discharged therefrom through the chutes 150 to the top of the relatively low fluidizing velocity zone of each of the fluidized beds 124. Thereafter, hot bed solids rain down upon the material 142*b* so as to thereby cover/mix with the freshly fed material 142*b*. The sloped roof, denoted by the reference numeral 68 in FIG. 2, below which the dual non-consolidating screws 146 are housed is designed to be operative to effectuate the sliding down therefrom of hot bed solids in the event that any hot bed solids might land on the roof 68 in the course of their being projected from the relatively high fluidizing velocity zone of each of the fluidized beds 124 to the relatively low fluidizing velocity zone thereof, thereby avoiding the accumulation of such hot bed solids on the roof 68**.

Thus to summarize, to scale up for a large size unit scale-up uncertainty can be reduced by providing mirror image baffle-bounded fluidized beds 124 within a split, i.e., pant-leg type, lower fluidized bed combustor 112. With such an arrangement there is featured inner relatively low fluidizing velocity zones with multi-openings of material feeding thereto from the center of the fluidized bed combustor 112 and symmetric baffle-bounded relatively high fluidizing velocity zones located at the outer sides of the fluidized bed combustor 112. Moreover, fluidized bed solids/gas mixtures move directionally from the baffle-bounded relatively high fluidizing velocity zones into the relatively low fluidizing velocity zones located at the center of the fluidized bed combustor 112. In addition, in-bed solids movement is controlled by the difference in bed density between the relatively high fluidizing velocity zone and the relatively low fluidizing velocity zone.

Another characteristic of the fluidized bed combustor 112 of FIG. 2 is that by virtue of the pant-leg type configuration thereof materials are discharged through the chutes 150 uniformly to the lower separated fluidized beds 124 through a common open channel. As such, the open channel is operative to maintain pressure balance between the separated lower portions 120 of the fluidized bed combustor 112.

Figure 3:
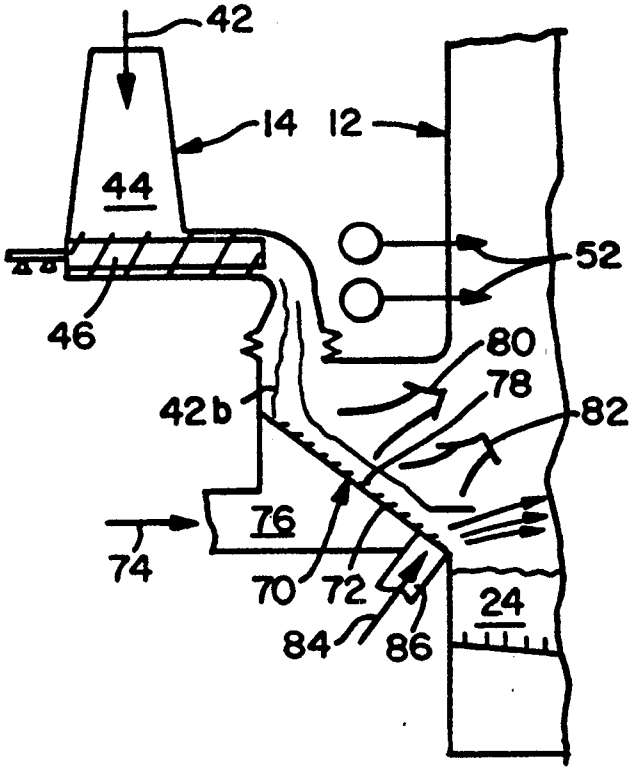
FIG. 3 is a diagrammatic representation in the nature of a vertical sectional view of a pre-drying means with which a fluidized bed combustion system constructed in accordance with the present invention may be provided.

In the event that because of the relatively high moisture content of the material 42 it would be desirable to effectuate a pre-drying thereof, such pre-drying may be accomplished in the manner illustrated in FIG. 3 of the drawing. To this end, in accordance with the illustration in FIG. 3 of the drawing a pre-drier means, generally denoted therein by the reference numeral 70, is interposed between the material feed means 14 and the fluidized bed 24 of the fluidized bed combustor 12. For ease of reference, some of the elements of the material feed means 14 that are depicted in FIG. 1 have been omitted in FIG. 3 in order to maintain clarity of illustration therein.

Thus, continuing with the description of the embodiment of the invention that is illustrated in FIG. 3 of the drawing, material 42 is supplied to the bin 44 and is discharged therefrom by operation of the screw means 46. More specifically, the material 42, as best understood with reference to FIG. 3, is discharged by the screw means 46 near the tip thereof and falls freely onto the pre-drier means 70. In accordance with the best mode embodiment of the invention the pre-drier means 70 includes a steeply sloping stationary, i.e., static, grate, denoted by the reference numeral 72 in FIG. 3. The grate 72 preferably forms a dedicated drier section within the fluidized bed combustor 12.

With further reference thereto, in accordance with the best mode embodiment of the invention the steeply sloping grate 72 is comprised of water cooled tubes that collectively form a gas tight membrane. The material, denoted by the reference numeral **42*b* in FIG. 3, proceeds down the grate 72** due to the influence thereupon of gravity and the assistance of gas depicted by the arrow denoted in FIG. 3 by the reference numeral 74, which is designed to be admitted through the surface of the grate 72. To this end, a gas plenum, denoted in FIG. 3 by the reference numeral 76, is located beneath the surface of the grate 72. The gases 74 pass through the surface of the grate 72 via openings (not shown) located between the tubes which comprise the grate 72, and are induced to travel directionally by use of directional deflection plates, denoted in FIG. 3 by the reference numeral 78, so as to assist motion of the material 42*b* on top of the surface of the grate 72 while minimizing entrainment of the fine fraction of material 42*b* in the gases 74. The gases 74 provided to the drying grate 72 may be air, which has been preheated to high temperatures, or flue gas, which has been extracted from the fluidized bed combustor 12 at a suitable temperature. Preference is given to the use in this regard of flue gas because it saves air for injection at 52 into the fluidized bed combustor 12 and, therefore, permits a reduction in the total amount of air required for combustion thereby leading to reduced thermal losses due to excess air and concomitantly higher thermal efficiencies for the fluidized bed combustion system 10. The gas 74 preferably is provided to the drying grate 72 at temperatures up to 750° F. and up to 15 in. wg. pressure, in quantities yielding superficial grate velocities of zero to five feet per second.

Continuing with the description of the pre-drier means 70, the material 42*b* upon settling into a traveling mat or bed on the surface of the grate 72 begins rapidly drying with the release of water vapor, depicted by the arrow denoted in FIG. 3 by the reference numeral 80. Drying is accomplished via three mechanisms: radiant heat absorption from the fluidized bed combustor 12, convective heat absorption from the gas 74 admitted beneath the grate 72, and direct contact with hot solids elutriated from the fluidized bed 24. The speed of travel, and depth of the travelling bed of material 42*b* on the grate 72 is set in large part by the fixed angle of inclination of the grate 72, and to a lesser extent by the superficial velocity of the gas 74 through the grate 72. The angle of inclination of the grate 72 is chosen to be greater than the angle of repose of the material 42*b*. An angle of 35° to 60° from the horizontal is suitable for many biomass materials. As the traveling bed of material 42*b* proceeds down the grate 72, the finer fractions thereof begin to gasify releasing combustible volatiles, depicted by the arrow denoted in FIG. 3 by the reference numeral 82, into the region above the grate 72. The drying grate 72 is sized to lower the bulk moisture content of the traveling bed of material 42*b* to that point where continuous self-sustaining combustion can be maintained within the fluidized bed 24. The material 42*b* leaves the drying grate 72 in a motion that combines "tumbling into" and "projecting over" the fluidized bed 24. Gas, depicted by the arrow denoted in FIG. 3 by the reference numeral 84, is admitted to the lowermost section of the drying grate 72 by a dedicated plenum, denoted in FIG. 3 by the reference numeral 86. Cold air at a pressure of 15–40 in. wg. pressure is admitted to the plenum 86 in order to assist with projecting the material 42*b* from the grate 72 out over the fluidized bed 24.

Figure 4:
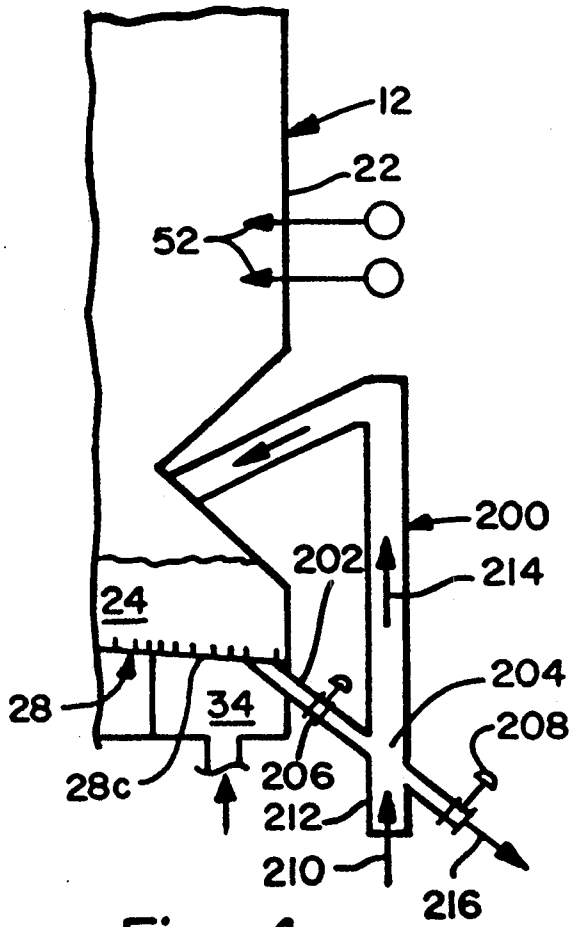
FIG. 4 is a diagrammatic representation in the nature of a vertical sectional view of another embodiment of removal means with which a fluidized bed combustion system constructed in accordance with the present invention may be provided.

Reference will next be had herein to FIG. 4 of the drawing wherein there is illustrated another embodiment of a removal means, generally denoted therein by the reference numeral 200, which the fluidized bed combustion system 10 may embody without departing from the essence of the present invention. Preferably, the removal means 200 operates in the manner of a batch process that is designed to be in continual operation. In accord with the mode of operation of the removal means 200, inerts/tramp materials/clinkers are induced by the slope of the air distributor 28 and the use of directional fluidizing nozzles to travel towards the lowermost portion of the fluidized bed 24 where they collect in a drain, denoted in FIG. 4 by the reference numeral 202. The drain 202 is connected to an individual bed classification chamber, denoted in FIG. 4 by the reference numeral 204, located externally of the fluidized bed combustor 12. Bed solids are admitted periodically to the external classification chamber 204 by briefly opening the valve, denoted in FIG. 4 by the reference numeral 206, while the valve, denoted in FIG. 4 by the reference numeral 208, is closed. Cold fluidizing air, depicted by the arrow denoted in FIG. 4 by the reference numeral 210, is admired to a plenum, denoted in FIG. 4 by the reference numeral 212, in sufficient quantities to entrain the bed solids while leaving the inerts/tramp materials/clinkers within the external classification chamber 204. Bed solids entrained in this manner are returned, as depicted by the arrow denoted in FIG. 4 by the reference numeral 214, to the fluidized bed combustor 12. The retention time for the inerts/tramp materials/clinkers remaining in the external classification chamber 204 can be adjusted to provide a measure of cooling thereof, before they are removed therefrom by virtue of the opening of valve 208. Material so removed, depicted by the arrow denoted in FIG. 4 by the reference numeral 216, may be sent to further heat recovery means or discharged directly.

The advantages of the removal means 200 are centered on the simplicity of operation thereof by virtue of the elimination of water cooled screws for ash removal and vibrating screws for classification of the material received by the removal means 200. Another feature is that all of the heat recovered from the inerts/tramp materials/clinkers can be returned to the fluidized bed combustor 12. Finally, it is possible to size the drain 202, classification chamber 204 and valves 206 and 208 such that large diameter solids can be discharged from the fluidized bed 24. However, the intent with the removal means 200 is to assure that large agglomerations are not formed by removing them before they have grown too large to flow into the drain 202. In this way the removal means 200 is designed to complement the aggressive internal circulation of bed solids, which tends to break up agglomerations within the fluidized bed 24, dislodges agglomerations from the walls 22 near the fluidized bed/freeboard interface before they have grown too large, and prevents formation of agglomerations due to local high temperature regions, which would be caused if the fluidized bed 24 were not so well mixed.

Thus, in accordance with the present invention there has been provided a new and improved combustion system suitable for use to effect therewith the incineration of waste materials in particular. Moreover, there has been provided in accord with the present invention such a new and improved combustion system for incinerating waste material which is characterized in that it is of the fluidized bed type. Besides, in accordance with the present invention there has been provided such a new and improved fluidized bed combustion system that is particularly suited for use to effect therewith the incineration of waste material when such waste material comprises biomass material. As well, there has been provided in accord with the present invention such a new and improved fluidized bed combustion system that is particularly suited for use to effect therewith the incineration of biomass material when such biomass material comprises wood waste/paper de-inking solids that have been generated as a by-product of paper recycling and de-inking operations of the type that are conducted by the paper and pulp industry. Moreover, in accordance with the present invention there has been provided such a new and improved fluidized bed combustion system for incinerating such wood waste/paper de-inking solids which is characterized in that the wood waste/paper de-inking solids are subjected to drying prior to being incinerated. Further, there has been provided in accord with the present invention such a new and improved fluidized bed combustion system for incinerating wood waste/paper de-inking solids which is characterized in that the drying of the wood waste/paper de-inking solids is accomplished by effecting the covering thereof with hot solids as the wood waste/paper de-inking solids is being introduced into the fluidized bed combustion system. Furthermore, in accordance with the present invention there has been provided such a new and improved fluidized bed combustion system for incinerating wood waste/paper de-inking solids which is characterized in that any inert/-tramp materials as well as large diameter solids entrained with the wood waste/paper de-inking solids are capable of being segregated therefrom and thereafter removed from the fluidized bed combustion system. Also, there has been provided in accord with the present invention such a new and improved fluidized bed combustion system for incinerating wood waste/paper de-inking solids which is characterized in that heat is capable of being both removed from such inert/tramp material as well as large diameter solids during the cooling thereof and of then being recycled to the fluidized bed combustion system. Additionally, in accordance with the present invention there has been provided such a new and improved fluidized bed combustion system for incinerating wood waste/paper de-inking solids wherein such incineration thereof is accomplished in an environmentally effective and efficient manner. Penultimately, there has been provided in accord with the present invention such a new and improved fluidized bed combustion system for incinerating wood waste/paper de-inking solids which is characterized by being equally well suited for use in retrofit applications as well as new applications. Finally, in accordance with the present invention there has been provided such a new and improved fluidized bed combustion system for incinerating wood waste/paper de-inking solids which is characterized by being easy to employ, by being reliable in operation, but which yet is relatively inexpensive to provide.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. An internal circulation fluidized bed combustion system for effecting the combustion of materials comprising:

a. a fluidized bed combustor including a fluidized bed, an air distributor means and a sloped baffle means, said fluidized bed being composed of bed solids, said air distributor means being operative to inject air into said fluidized bed to create a plurality of controlled fluidizing velocity zones within said fluidized bed, one of said plurality of controlled fluidizing velocity zones embodying a relatively high fluidizing velocity and a relatively low bed density, another one of said plurality of controlled fluidizing velocity zones embodying a relatively low fluidizing velocity and a relatively high bed density, said air distributor means further being sloped in a downwardly direction from said another one of said plurality of controlled fluidizing velocity zones to said one of said plurality of controlled fluidizing velocity zones in order to enhance the movement of inerts, tramp materials, clinkers as well as large diameter solids through said fluidized bed combustor, said sloped baffle means having a first portion extending below the level of said fluidized bed so as to thereby bound a portion of said one of said plurality of controlled fluidizing velocity zones of said fluidized bed and having a second portion thereof extending above said one of said plurality of controlled fluidizing velocity zones of said fluidized bed, said sloped baffle means being operative to promote the growth of gas bubbles within said one of said plurality of controlled fluidizing velocity zones in order to thereby maximize the momentum within said one of said plurality of controlled fluidizing velocity zones of the gas bubbles and bed solids upwards along said sloped baffle means until the end of said second portion thereof is reached thereby such that the momentum possessed by the gas bubbles and bed solids coupled with the force created by the bursting of the gas bubbles as the gas bubbles reach the end of said second portion of said sloped baffle means is sufficient to project bed solids from said one of said plurality of controlled fluidizing velocity zones to said another one of said plurality of controlled fluidizing velocity zones whereupon the projected bed solids rain down on said another one of said plurality of controlled fluidizing velocity zones;

b. material feed means for introducing the material to be combusted into said fluid bed combustor above said another one of said plurality of controlled fluidizing velocity zones whereupon bed solids projected from said one of said plurality of controlled fluidizing velocity zones rain down on the material so introduced thereby covering the material and concomitantly initiating the drying thereof; and c. removal means cooperatively associated with said fluidized bed and operative to effect the separation and subsequent removal from said fluidized bed combustor of inerts, tramp materials, clinkers as well as large diameter solids entrained within the material introduced into said fluidized bed combustor by means of said material feed means, said removal means including a seal loop having a first leg and a second leg, said first leg terminating at one end thereof in a drain opening located in juxtaposed relation to said air distributor means for receiving inerts, tramp materials, clinkers as well as large diameter solids therefrom, said second leg being joined to the other end of said first leg for receiving inerts, tramp materials, clinkers as well as large diameter solids from said first leg after the passage thereof through said first leg, said second leg including classifying means operative to effect the segregation during the passage through said second leg of the inerts, tramp materials, clinkers as well as large diameter solids of the fines entrained therewith, said second leg being operative to effect the discharge therefrom at a first location thereof of the fines and to effect the discharge therefrom at a second location thereof of the inerts, tramp materials, clinkers as well as large diameter solids after the fines have been removed therefrom.

2. The internal circulation fluidized bed combustion system as set forth in claim 1 wherein the material introduced by means of said material feed means into said fluidized bed combustor for combustion therewithin comprises biomass material.

3. The internal circulation fluidized bed combustion system as set forth in claim 2 wherein the biomass material introduced by means of said material feed means into said fluidized bed combustor for combustion therewithin comprises wood waste and paper de-inking solids.

4. The internal circulation fluidized bed combustion system as set forth in claim 1 wherein said fluidized bed combustor has a plurality of walls and said sloped baffle means comprises a portion of one of said plurality of walls.

5. The internal circulation fluidized bed combustion system as set forth in claim 4 wherein said sloped baffle means is lined with a refractory-type material.

6. The internal circulation fluidized bed combustion system as set forth in claim 1 wherein said material feed means includes a material storage bin, screw means, rotary air lock means and a chute, said screw means being operative to discharge material to said rotary air lock means from said material storage bin, said rotary air lock means including at least one rotary feeder for feeding material to said chute from said rotary air lock means, said chute being cooperatively associated with said fluidized bed combustor and being operative to convey the material received thereby from said rotary air lock means to within said fluidized bed combustor such that the material is introduced into said fluidized bed combustor above said another one of said plurality of controlled fluidizing velocity zones of said fluidized bed.

7. The internal circulation fluidized bed combustion system as set forth in claim 1 further comprising pre-drier means interposed between said material feed means and said fluidized bed, said pre-drier means being operative for receiving material from said material feed means and for conveying the material to said fluidized bed, said pre-drier means further being operative to effect a pre-drying of the material as the material is conveyed by said pre-drier means to said fluidized bed.

8. The internal circulation fluidized bed combustion system as set forth in claim 1 wherein:

a. said fluidized bed combustor includes a pair of fluidized beds, a pair of air distributor means and a pair of sloped baffle means, each of said pair of air distributor means being operative to inject air into a corresponding one of said pair of fluidized beds to create a plurality of controlled fluidizing velocity zones within said corresponding one of said pair of fluidized beds, each of said pair of sloped baffle means having a first portion extending below the level of a corresponding one of said pair of fluidized beds so as to thereby bound a portion of one of said plurality of controlled fluidizing velocity zones of said pair of fluidized beds and having a second portion thereof extending above said one of said plurality of controlled fluidizing velocity zones of said corresponding one of said pair of fluidized beds;

b. said material feed means being operative for introducing the material to be combusted into said fluidized bed combustor above another one of said plurality of controlled fluidizing velocity zones of each of said pair of fluidized beds; and c. said removal means being cooperatively associated with each of said pair of fluidized beds and being operative to effect the separation and subsequent removal from said fluidized bed combustor of inerts, tramp materials, clinkers as well as large diameter solids entrained within the material introduced into said fluidized bed combustor by means of said material feed means.

9. An internal circulation fluidized bed combustion system for effecting the combustion of materials comprising:

a. a fluidized bed combustor including a fluidized bed, an air distributor means and a sloped baffle means, said fluidized bed being composed of bed solids, said air distributor means being operative to inject air into said fluidized bed to create a plurality of controlled fluidizing velocity zones within said fluidized bed, one of said plurality of controlled fluidizing velocity zones embodying a relatively high fluidizing velocity and a relatively low bed density, another one of said plurality of controlled fluidizing velocity zones embodying a relatively low fluidizing velocity and a relatively high bed density, said air distributor means further being sloped in a downwardly direction from said another one of said plurality of controlled fluidizing velocity zones to said one of said plurality of controlled fluidizing velocity zones in order to enhance the movement of inerts, tramp materials, clinkers as well as large diameter solids through said fluidized bed combustor, said sloped baffle means having a first portion extending below the level of said fluidized bed so as to thereby bound a portion of said one of said plurality of controlled fluidizing velocity zones of said fluidized bed and having a second portion thereof extending above said one of said plurality of controlled fluidizing velocity zones of said fluidized bed, said sloped baffle means being operative to promote the growth of gas bubbles within said one of said plurality of controlled fluidizing velocity zones in order to thereby maximize the momentum within said one of said plurality of controlled fluidizing velocity zones of the gas bubbles and bed solids upwards along said sloped baffle means until the end of said second portion thereof is reached thereby such that the momentum possessed by the gas bubbles and bed solids coupled with the force created by the bursting of the gas bubbles as the gas bubbles reach the end of said second portion of said sloped baffle means is sufficient to project bed solids from said one of said plurality of controlled fluidizing velocity zones to said another one of said plurality of controlled fluidizing velocity zones whereupon the projected bed solids rain down on said another one of said plurality of controlled fluidizing velocity zones;

b. material feed means for introducing the material to be combusted into said fluid bed combustor above said another one of said plurality of controlled fluidizing velocity zones whereupon bed solids projected from said one of said plurality of controlled fluidizing velocity zones rain down on the material so introduced thereby covering the material and concomitantly initiating the drying thereof; and c. removal means cooperatively associated with said fluidized bed and operative to effect the separation and subsequent removal from said fluidized bed combustor of inerts, tramp materials, clinkers as well as large diameter solids entrained within the material introduced into said fluidized bed combustor by means of said material feed means, said removal means including a drain, classification chamber means cooperatively associated with said drain and valve means cooperatively associated with both said drain and said classification chamber means, said drain having one end thereof located in juxtaposed relation to said air distributor means for receiving inerts, tramp materials, clinkers as well as large diameter solids therefrom, said classification chamber means being operative to effect the segregation from the inerts, tramp materials, clinkers as well as large diameter solids of the fines entrained therewith, said valve means being operative to effect the movement of the inerts, tramp materials, clinkers as well as large diameter solids from said drain to said classification chamber means and to effect the discharge from said removal means at a first location thereof of the fines and at a second location thereof of the inerts, tramp materials, clinkers as well as large diameter solids after the fines have been removed therefrom.

10. The internal circulation fluidized bed combustion system as set forth in claim 9 wherein:

a. said fluidized bed combustor includes a pair of fluidized beds, a pair of air distributor means and a pair of sloped baffle means, each of said pair of air distributor means being operative to inject air into a corresponding one of said pair of fluidized beds to create a plurality of controlled fluidizing velocity zones within said corresponding one of said pair of fluidized beds, each of said pair of sloped baffle means having a first portion extending below the level of a corresponding one of said pair of fluidized beds so as to thereby bound a portion of one of said plurality of controlled fluidizing velocity zones of said pair of fluidized beds and having a second portion thereof extending above said one of said plurality of controlled fluidizing velocity zones of said corresponding one of said pair of fluidized beds;

b. said material feed means being operative for introducing the material to be combusted into said fluidized bed combustor above another one of said plurality of controlled fluidizing velocity zones of each of said pair of fluidized beds; and c. said removal means being cooperatively associated with each of said pair of fluidized beds and being operative to effect the separation and subsequent removal from said fluidized bed combustor of inerts, tramp materials, clinkers as well as large diameter solids entrained within the material introduced into said fluidized bed combustor by means of said material feed means.

11. A method of operating a fluidized bed combustion system to effect therewith the combustion of material comprising the steps of:

a. providing a fluidized bed combustor embodying a fluidized bed composed of bed solids;

b. injecting air into the fluidized bed to establish at a first location thereof a first controlled fluidizing velocity zone having a relatively high fluidizing velocity and a relatively low bed density;

c. injecting air into the fluidized bed to establish at a second location thereof a second controlled fluidizing velocity zone having a relatively low fluidizing velocity and relatively high bed density;

d. creating a circulation of the bed solids within the fluidized bed;

e. promoting the growth of gas bubbles within the first controlled fluidizing velocity zone to maximize the upward momentum of the gas bubbles and bed solids within the first controlled fluidizing velocity zone;

f. projecting bed solids from the first controlled fluidizing velocity zone to the second controlled fluidizing velocity zone as a consequence of the upward movement of the gas bubbles and bed solids within the first controlled fluidizing velocity zone coupled with the force of the gas bubbles bursting whereupon the projected bed solids rain down upon the second controlled fluidizing velocity zone;

g. introducing into the fluidized bed combustor above the second controlled fluidizing velocity zone to be combusted therewithin the material having inerts, tramp materials, clinkers as well as large diameter solids entrained therewith;

h. covering the material so introduced into the fluidized bed combustor with bed solids that rain down thereupon after being projected from the first controlled fluidizing velocity zone to the second controlled fluidizing velocity zone;

i. effecting the drying of the material so introduced followed by the subsequent combustion thereof;

j. establishing a downward slope between the second controlled fluidizing velocity zone and the first controlled fluidizing velocity zone in order to enhance the movement of the inerts, tramp materials, clinkers as well as large diameter solids within the fluidized bed combustor;

k. providing a device for receiving the inerts, tramp materials, clinkers as well as large diameter solids from the first controlled fluidizing velocity zone;

l. effecting the segregation of the inerts, tramp materials, clinkers as well as large diameter solids from the fines entrained therewith during the passage thereof through the device;

m. effecting thereafter the discharge of the fines at a first location; and n. effecting thereafter the discharge of the inerts, tramp materials, clinkers as well as large diameter solids at a second location.

12. The method of operating a fluidized bed combustion system as set forth in claim 11 wherein the material introduced into the fluidized bed combustor comprises biomass material.

13. The method of operating a fluidized bed combustion system as set forth in claim 12 wherein the biomass material introduced into the fluidized bed combustor comprises wood waste and paper de-inking solids.

14. The method of operating a fluidized bed combustion system as set forth in claim 11 wherein the fluidizing velocity in the first controlled fluidizing velocity zone is between 5 and 12 feet per second.

15. The method of operating a fluidized bed combustion system as set forth in claim 11 wherein the fluidizing velocity in the second controlled fluidizing velocity zone is between 2 and 3 feet per second.

16. The method of operating a fluidized bed combustion system as set forth in claim 11 further comprising the step of pre-drying the material to be combusted within the fluidized bed combustor before introducing the material above the second controlled fluidizing velocity zone.

* * * * *